US008550396B2

(12) United States Patent
Marrs

(10) Patent No.: US 8,550,396 B2
(45) Date of Patent: Oct. 8, 2013

(54) TOILET PAPER DISPENSER FOR COVERING WALL-MOUNTED PRE-EXISTING TOILET PAPER ROLLER AND AUTOMATING HANDS-FREE TOILET PAPER EXTRACTION THEREFROM

(75) Inventor: William Anthony Marrs, Chula Vista, CA (US)

(73) Assignee: William Anthony Marrs, Chula Vista, CA (US)

( * ) Notice: Subject to any disclaimer, the term of this patent is extended or adjusted under 35 U.S.C. 154(b) by 269 days.

(21) Appl. No.: 13/052,321

(22) Filed: Mar. 21, 2011

(65) Prior Publication Data

US 2011/0226887 A1 Sep. 22, 2011

Related U.S. Application Data

(60) Provisional application No. 61/316,338, filed on Mar. 22, 2010.

(51) Int. Cl.
*B65H 16/10* (2006.01)

(52) U.S. Cl.
USPC ..... 242/564

(58) Field of Classification Search
USPC ..... 242/563, 563.2, 564, 564.1, 564.3, 242/564.4, 565; 312/34.8, 34.9, 34.11, 34.12, 312/34.14, 34.16, 34.18, 34.19, 34.21, 34.22, 312/34.23, 34.24; 248/905, 309.1, 266, 200.1
See application file for complete search history.

(56) References Cited

U.S. PATENT DOCUMENTS

| | | | | |
|---|---|---|---|---|
| 5,772,291 | A * | 6/1998 | Byrd et al. | 312/34.22 |
| 6,105,898 | A * | 8/2000 | Byrd et al. | 242/564.1 |
| 6,609,449 | B2 * | 8/2003 | Granger | 83/649 |
| 6,695,246 | B1 * | 2/2004 | Elliott et al. | 242/564.1 |
| 6,854,684 | B2 * | 2/2005 | Byrd et al. | 242/563 |
| 6,903,654 | B2 * | 6/2005 | Hansen et al. | 340/562 |
| 7,354,015 | B2 * | 4/2008 | Byrd et al. | 242/563 |
| 7,644,885 | B2 * | 1/2010 | Briante et al. | 242/588.6 |
| 2008/0245922 | A1 | 10/2008 | Fellhoelter | |
| 2009/0272836 | A1 * | 11/2009 | Byrd et al. | 242/563 |

* cited by examiner

*Primary Examiner* — Sang Kim
*Assistant Examiner* — Juan Campos, Jr.

(57) ABSTRACT

A toilet paper dispenser has a housing to cover a wall-mounted pre-existing toilet paper roller. The housing defines a rear periphery defining a wall opening configured for accepting the toilet paper roller therethrough. A pair of operating rollers are rotatably mounted in the housing and are closely spaced from each other to closely receive toilet paper from toilet paper roller therebetween. A motor is mounted in the housing and is coupled to the operating rollers to rotate at least one of the rollers. A presence sensor and a processor are included with the housing, where the processor is capable of receiving signals from the presence sensor. Responsive to a signal from the presence sensor indicating the presence of a hand, the processor energizes the motor to turn the operating rollers. The housing has a bottom opening through which toilet paper is dispensed when the operating rollers are turned.

17 Claims, 3 Drawing Sheets

TOILET PAPER DISPENSER FOR COVERING WALL-MOUNTED PRE-EXISTING TOILET PAPER ROLLER AND AUTOMATING HANDS-FREE TOILET PAPER EXTRACTION THEREFROM

This application claims priority from U.S. provisional patent application 61/316,338, filed Mar. 22, 2010, incorporated herein by reference.

FIELD OF THE INVENTION

The present invention relates generally to automatic toilet paper dispensers.

BACKGROUND OF THE INVENTION

Toilet paper dispensers having at least one toilet paper roll are often used by multiple individuals to dispense toilet paper. Because multiple individuals may come into contact with the same toilet paper dispenser and/or toilet paper roll, there is often an increased risk of transmitting biological agents such as germs, bacteria, and infectious diseases (e.g., H1N1) between users of the toilet paper dispenser and toilet paper roll because multiple individuals may come into contact (e.g., touch) with the toilet paper dispenser and toilet paper roll.

The present application recognizes that, by disposing a roll of toilet paper within a housing and allowing for hands-free toilet paper dispensing, the risk of transmitting biological agents between people may be reduced. In addition, the present application may also provide a more convenient dispensing of toilet paper, and may also conserve waste.

SUMMARY OF THE INVENTION

Because of the foregoing, a need has arisen for a toilet paper dispenser automating hands-free toilet paper extraction therefrom. Accordingly, a toilet paper dispenser may cover a wall-mounted, pre-existing toilet paper roller to automate hands-free toilet paper extraction therefrom in accordance with present principles. In non-limiting embodiments, the toilet paper dispenser may have a hollow housing, where the housing may define a rear periphery. If desired, the housing may be parallelepiped-shaped and may be made of plastic.

In some implementations, the rear periphery may define a wall opening configured for accepting a wall-mounted toilet paper roller therethrough. The wall opening may or may not be closable or coverable by structure on the housing. Additionally, a top and sides of the rear periphery bounding the wall opening may be defined by respective rear edges of a flat top panel that may be orthogonal to the wall opening, a flat right panel connected to a right end portion of the top panel and perpendicular thereto, and a flat left panel connected to a left end portion of the top panel and perpendicular thereto. Also, four tape elements may be arranged on the rear periphery, one at each corner thereof, in non-limiting embodiments such that the tape elements may be engaged with the wall.

Also in non-limiting embodiments, the toilet paper dispenser may include a pair of operating rollers that are rotatably mounted in the housing and are closely spaced from each other to closely receive toilet paper from the wall-mounted pre-existing toilet paper roller therebetween. If desired, the operating rollers may be generally parallel to each other. Further, the operating rollers may have tacky surfaces, and/or may have soft plastic or rubber surfaces, in non-limiting embodiments to facilitate receipt of the toilet paper between the operating rollers.

Even further, in some implementations, the toilet paper dispenser may include a motor in the housing, where the motor may be coupled to one or both operating rollers to rotate at least one of the rollers. In non-limiting embodiments, the motor may be coupled to the operating rollers by engaging gears therebetween.

If desired, the toilet paper dispenser may also include a presence sensor on the housing. The toilet paper dispenser may also include a processor on the housing, where the processor may be capable of receiving signals from the presence sensor and, responsive to a signal indicating the presence of a person (e.g., the presence of a person's hand near the presence sensor), energize the motor to turn the operating rollers. In non-limiting embodiments, the housing may further define a bottom opening through which toilet paper received by the operating rollers may be dispensed when the operating rollers are turned by the motor. In non-limiting embodiments, the bottom opening may be defined by a slot in a bottom panel of the housing, where the bottom panel of the housing may connect bottom end portions of the left and right side panels. Thus, toilet paper may be automatically dispensed from the housing through the slot.

Further still, in non-limiting embodiments, the housing of the toilet paper dispenser may also define a front periphery, where the front periphery may define a front opening allowing access to the wall-mounted pre-existing toilet paper roller. If desired, the front opening may be selectively covered by a movable panel of the housing.

In another aspect, a method may include disposing a housing over a wall-mounted, pre-existing toilet paper roller without removing the wall-mounted pre-existing toilet paper roller from a wall on which it is mounted. The method may also include engaging paper from the wall-mounted pre-existing toilet paper roller with at least one operating roller on the housing. In non-limiting embodiments, the method may also include that, responsive to detection of presence of a hand near the housing, the operating roller may be automatically rotated to translationally move paper through an opening in the housing such that the paper can be grasped by a person and torn from a roll of paper for use.

In still another aspect, a system may include a toilet paper dispenser, where the toilet paper dispenser may include a hollow housing for accepting a toilet paper roller therethrough. In non-limiting embodiments, the system may also include at least one operating roller rotatably mounted in the housing and engaged with toilet paper from the toilet paper roller. The system may also include a motor in the housing, wherein the motor is coupled to the at least one operating roller to rotate the at least one operating roller.

If desired, the system may also include a presence sensor and a processor on the housing. The processor may be capable of receiving signals from the presence sensor, wherein the processor energizes the motor to turn the at least one operating roller responsive to a signal indicating the presence of a person. In non-limiting embodiments, the housing may further define an opening through which toilet paper is dispensed when the at least one operating roller is turned.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
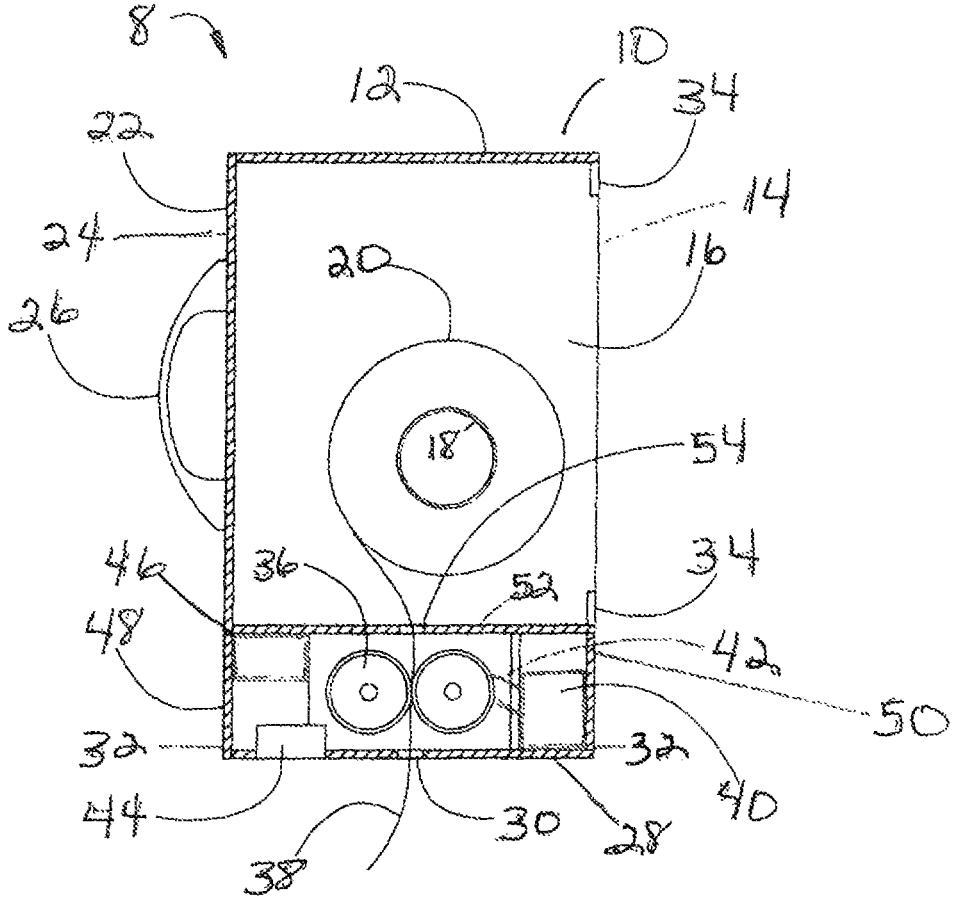
FIG. 1 is a side plane view of a non-limiting, exemplary embodiment of a toilet paper dispenser in accordance with present principles.

Beginning initially with FIG. 1, a side plane view of a non-limiting, exemplary embodiment of a toilet paper dispenser in accordance with present principles is shown. Thus, a toilet paper dispenser generally designated 8 is shown. The toilet paper dispenser 8 has a housing 10. In non-limiting embodiments, the housing 10 may be is parallelepiped-shaped and may be generally hallow. Further, the housing 10 may be made out of a material such as, but not limited to, plastic, Plexiglas, metal or a metal alloy, carbon fiber, styrofoam, wood, cardboard, and/or glass. Additionally, in non-limiting embodiments, the housing may 10 include a decorative design, or otherwise be covered with a decorative design and/or material, to be aesthetically pleasing.

In non-limiting embodiments, the housing 10 may define a rear periphery 14, where the rear periphery 14 may define a wall opening 16 that may be configured to accept a wall-mounted pre-existing toilet paper roller 18. It is to be understood that, in non-limiting embodiments, the top and sides of the rear periphery 14 bounding the wall opening may be defined by respective rear edges of a top panel 12 that may be orthogonal to the wall opening.

Further, it is to be understood that the wall opening 16 may not be closable or coverable by structure on the housing 10 in non-limiting embodiments. Thus, the housing 10 may be disposed over the wall-mounted pre-existing toilet paper roller 18 without removing the wall-mounted pre-existing toilet paper roller from a wall on which it is mounted.

It is to be further understood that the toilet paper roller 18 may include at least one toilet paper roll 20. The toilet paper roll 20 may be engaged with the toilet paper roller 18 by, e.g., sliding the toilet paper roll 20 onto the toilet paper roller 18 from an end of the toilet paper roller 18.

In non-limiting embodiments, the housing 10 may further define a front periphery 22. The front periphery 22 may define a front opening for access to the wall-mounted pre-existing toilet paper roller 18. The rear periphery 14 and front periphery 22 will be further described below.

Continuing in reference to FIG. 1, the front opening may be selectively covered by a movable panel 24 of the housing 10. Additionally, the movable panel 24 may optionally have a handle 26. However, it is to be understood that the movable panel 24 may have a knob in additional to or instead of the handle 26 shown in FIG. 1. Further, in other non-limiting embodiments, the movable panel 24 may have no handle or knob. Instead, the movable panel 24 may not have any grasping element protruding therefrom. Regardless, the movable panel 24 may be moved between open and closed configurations Still in reference to FIG. 1, in non-limiting embodiments, the housing 10 may further define a bottom panel 28 having an opening 30. The opening 30 may be defined by a slot in the bottom panel 28, which will be further described below. Thus, toilet paper 38 may be dispensed from the housing 10 through the opening 30 in accordance with present principles.

Further, the bottom panel 28 may connect bottom end portions 32 of generally vertical sides and/or panels of the housing 10, such as but not limited to a right side panel and a left side panel, in non-limiting embodiments. The right and left side panels will be described further below.

Additionally, as shown in FIG. 1, tape elements 34 may be arranged on the rear periphery 14. In non-limiting embodiments, the tape elements 34 may be arranged with at least one at each corner of the rear periphery 14. When the toilet paper dispenser 8 is disposed over the wall-mounted pre-existing toilet paper roller 18, the toilet paper dispenser 8 may remain static relative to the toilet paper roller 18 when the tape elements 34 are engaged with the wall on which the toilet paper roller 18 is mounted. However, it is to be understood, in other non-limiting embodiments, other elements may be used to engage the toilet paper dispenser 8 with the wall, such as nails, screws, brackets, hangers, and/or bolts.

Moving on, the non-limiting, exemplary embodiment of the toilet paper dispenser 8 shown in FIG. 1 also has a pair of operating rollers 36 rotatably mounted in the housing 10. However, it is to be understood that, in other non-limiting embodiments, one operating roller or more than two operating rollers may be rotatably mounted in the housing 10 in accordance with present principles. Further, in non-limiting embodiments, the operating rollers 36 may have a tacky surface(s). In addition to or in lieu of a tacky surface, the operating rollers 36 may have a soft plastic or rubber surface(s). In still other non-limiting embodiments, the operating rollers 36 may be wrapped in polyurethane.

Continuing in reference to the operating rollers 36 of FIG. 1, the operating rollers 36 are understood to be closely spaced from each other, and may also be parallel to each other in non-limiting embodiments, to closely receive toilet paper 38 from the wall-mounted pre-existing toilet paper roller 18 therebetween. The surface(s) of the operating rollers 36 as described herein, (e.g., a tacky surface, a soft plastic or rubber surface, and/or a polyurethane surface) may thus facilitate receipt of the toilet paper 38 between the operating rollers 36 in accordance with present principles by, e.g., creating friction between the toilet paper 38 and the operating rollers 36.

At least one motor 40 may be included in the housing 10, where the motor 40 may be coupled to and/or engaged with the operating rollers 36 by gears 42 to rotate at least one of the operating rollers 36 in accordance with present principles. It is to be understood that the motor 40 may be coupled to only one of the operating rollers 36 such that the other operating roller is not coupled to the motor 40. In other non-limiting embodiments, the motor 40 may be coupled to both operating rollers 36 by the gears 42. It is to be further understood that, in non-limiting embodiments where the toilet paper dispenser 8 includes more than two operating rollers, the motor 40 may be coupled to some or all of the operating rollers by the gears 42. It is to be understood that, in non-limiting embodiments, the motor 40 may be mounted on the bottom panel 28.

As shown in FIG. 1, the housing 10 may also include at least one non-limiting presence sensor 44. The presence sensor 44 may be, without limitation, a sensor for sensing the presence of a person or a portion or a person (e.g. a hand) nearby the dispenser. The presence sensor 44 may be, without limitation, a motion sensor, an optical sensor, and/or a personal area network sensor in non-limiting embodiments. If desired, the presence sensor 44 may be an infrared-based motion sensor in non-limiting embodiments, such as, but not limited to, the motion sensor disclosed in U.S. Pat. No. 7,399,969, incorporated herein by reference.

The housing 10 may also include at least one processor 46 that may be electrically connected to the presence sensor 44. The processor 46 may be capable of receiving and processing signals from the presence sensor 44. The processor 46 may also be electrically connected to the motor 40 to energize the motor 40 such that the motor 40 may rotate or one or more of the operating rollers 36 when the processor 46 receives a signal from the presence sensor 44 indicating presence of a hand near the housing 10. Thus, toilet paper 38 may transitionally pass through the opening 30 when the processor 46 energizes the motor 40. After passing through the opening 30, the toilet paper 38 can then be grasped by a person and torn from the toilet paper roll 20 for use.

Further, it is to be understood that the length of time the processor 46 may energize the motor 40 may be predetermined in non-limiting embodiments. For example, the processor 46 may energize the motor 40 for two seconds. However, in still other non-limiting embodiments, the processor 46 may energize the motor 40 to dispense a predetermined amount of toilet paper. For example, the processor 46 may energize the motor 40 such that two sheets and/or plies or toilet paper may be dispensed.

It is to be understood that a power supply (not shown) may also be place on the housing 10 to provide power to the components described herein (such as the motor 40, presence sensor 44, and processor 46) in accordance with present principles. In non-limiting embodiments, the power supply may be a battery, a light source in the room in which the toilet paper dispenser 8 is disposed, and/or an electrical outlet. Even further, the power source may be accessible within the housing 10 such that, e.g., a battery or batteries may be replaced if necessary.

Still in reference to FIG. 1, the housing 10 may also include a lower front panel 48 and a lower rear panel 50 in non-limiting embodiments. A cross-sectional panel 52 may be perpendicular to and partially define the upper edges of the lower front panel 48 and lower rear panel 50. Additionally, the cross-sectional panel 52 may be perpendicular to the rear periphery 14 and front periphery 22. Also in non-limiting embodiments, the cross-sectional panel 52 may have an opening 54 through which toilet paper 38 may pass, where the opening 54 may be substantially similar in configuration to the opening 30 described above. Thus, the cross-sectional panel 52 may at least partially separate a portion of the housing 10 including the toilet paper roller 18 from a portion of the housing 10 including the operating rollers 36, motor 40, gears 42, presence sensor 44, and processor 46.

Figure 2:
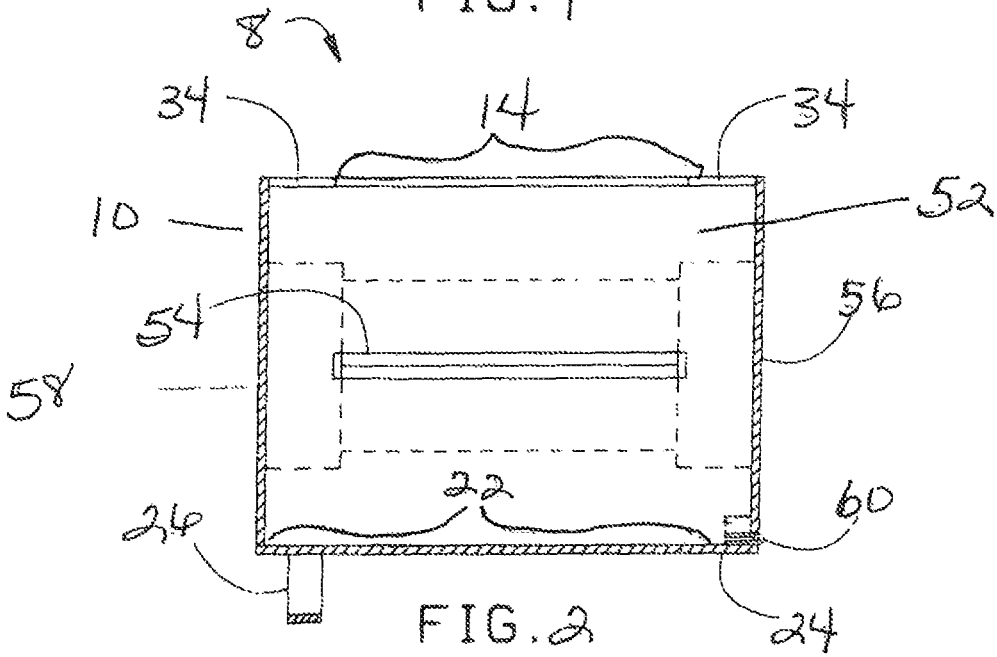
FIG. 2 is a bottom plane view of a non-limiting, exemplary embodiment of a cross-sectional panel of the toilet paper dispenser in accordance with present principles.

Now in reference to FIG. 2, a bottom plane view of the cross-sectional panel 52 of the toilet paper dispenser 8 is shown. As shown in FIG. 2, the cross-sectional panel 52 may be generally perpendicular to a left side panel 56 and a right side panel 58. In non-limiting embodiments such as the one shown in FIG. 2, the housing 10 may also include a hinge element(s) 60 mechanically connecting and/or engaging the movable panel 24 with another panel on the housing 10, such as the left side panel 56 as shown in FIG. 2, such that the movable panel 24 may move between open and closed configurations.

Additionally, it may be appreciated from FIG. 2 that the cross-sectional panel 52 may in part define the rear periphery 14 and front periphery 22 in accordance with present principles. It may be further appreciated from FIG. 2 that the cross-sectional panel 52 may have an opening 54 that may be defined by a slot through which toilet paper 38 (not shown in FIG. 2) may translationally move.

Figure 3:
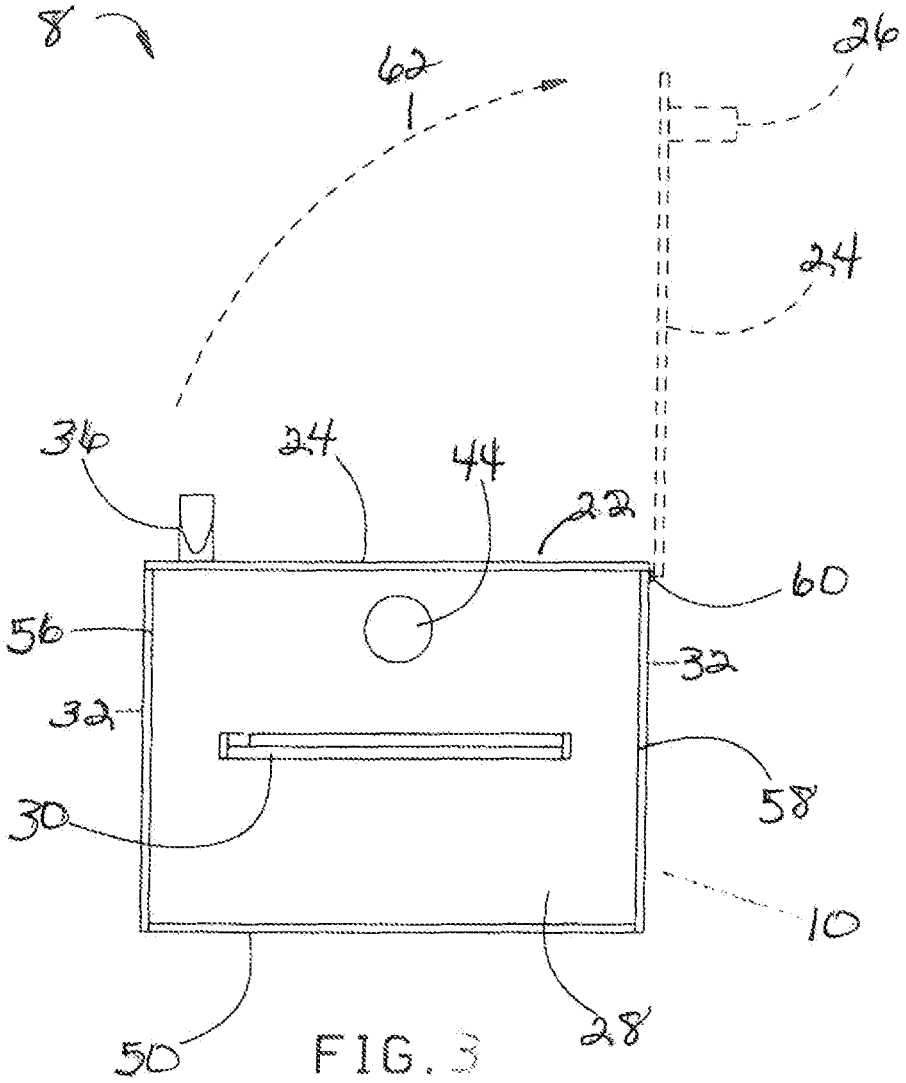
FIG. 3 is a bottom plane view of a non-limiting, exemplary embodiment of a bottom panel of the toilet paper dispenser in accordance with present principles.

Now in reference to FIG. 3, a bottom plane view of the bottom panel 28 of the toilet paper dispenser 8 is shown. As shown in FIG. 3, the bottom panel 28 may connect bottom end portions 32 of a left side panel 56 and a right side panel 58. Additionally, the bottom panel 28 may be generally perpendicular to a lower rear panel 50. In non-limiting embodiments such as the one shown in FIG. 3, the housing 10 may also include a hinge element(s) 60 mechanically connecting and/or engaging the movable panel 24 with another panel on the housing 10, such as the right side panel 58 as shown in FIG. 3. It may be appreciated from the non-limiting embodiment shown in FIG. 3 that the movable panel 24, which may optionally have a handle 26, may move between open and closed configurations as indicated by the directional arrow 62. It may be further appreciated that the movable panel 24 may define at least a bottom portion of the front periphery 22. Thus, the front periphery 22 may allow access to a front opening on the housing 10 when the movable panel 24 is in the open configuration.

Continuing in reference to the non-limiting embodiment shown in FIG. 3, the housing 10 may also include a presence sensor 44 positioned on the bottom panel 28 such that it may sense the presence of a person's hand beneath the toilet paper dispenser 8. Additionally, it may be appreciated from FIG. 3 that the bottom panel 28 may have an opening 30 that may define by a slot in the bottom panel 28 through which toilet paper 38 (not shown in FIG. 3) may translationally move.

Figure 4:
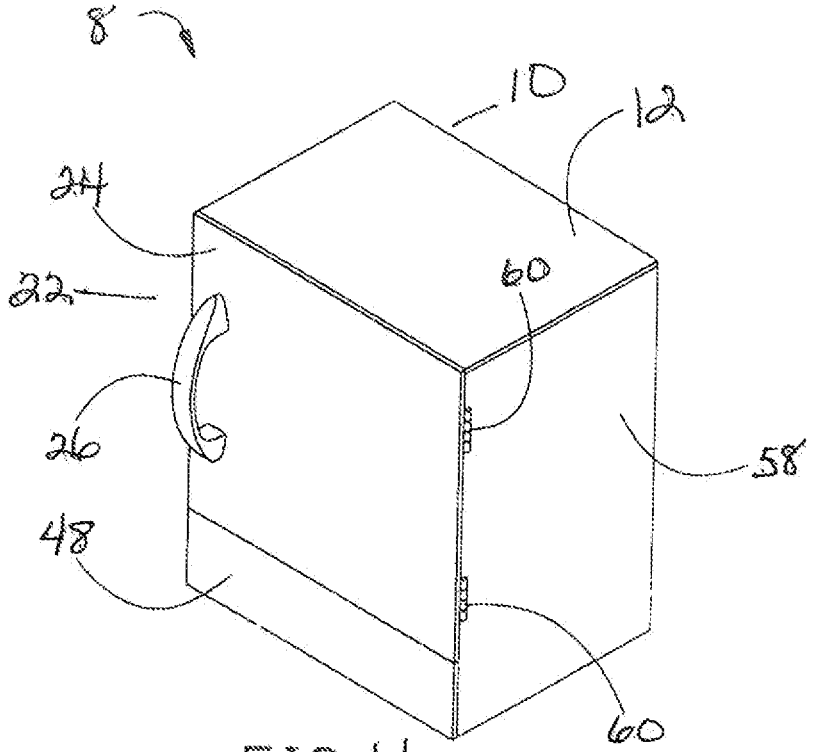
FIG. 4 is a side elevational view of a non-limiting, exemplary embodiment of a front of the toilet paper dispenser housing in accordance with present principles.

Now in reference to FIG. 4, a side elevational view of the front of a toilet paper dispenser housing in accordance with present principles is shown. Thus, the non-limiting, side elevational view of FIG. 4 shows a toilet paper dispenser 8 which includes a housing 10. The housing 10 may have a top panel 12 that may be flat in non-limiting embodiments. The housing 10 may further include a movable panel 24 optionally having a handle 26, a lower front panel 48 that may at least partially define the bottom of a front periphery 22, a right side panel 58, and plural hinge elements 60. The non-limiting embodiment shown in FIG. 4 shows the movable panel 24 in a closed configuration.

Figure 5:
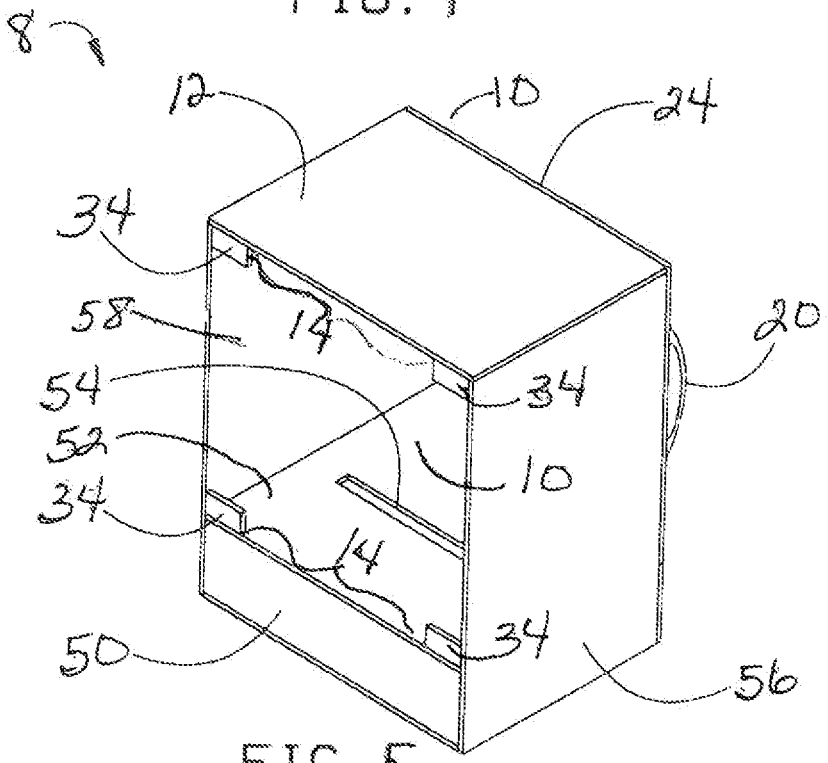
FIG. 5 is a side elevational view of a non-limiting, exemplary embodiment of a rear of the toilet paper dispenser housing in accordance with present principles.

Now in reference to FIG. 5, a side elevational view of the rear of a toilet paper dispenser housing in accordance with present principles is shown. Thus, the non-limiting, side elevational view of FIG. 5 shows a toilet paper dispenser 8 which includes a housing 10. The housing 10 may have a top panel 12 that may be flat in non-limiting embodiments. The housing 10 may further include a movable panel 24 optionally having a handle 26, a cross-sectional panel 52 having an opening 54, a left side panel 56, and a right side panel 58.

Further, the non-limiting embodiment of FIG. 5 also shows a lower rear panel 50 that may at least partially define a bottom portion of the rear periphery 14. It is to be understood that the rear periphery 14 may define a wall opening 16 in accordance with present principles. Further, it may be appreciated from the non-limiting embodiment shown in FIG. 5 that the top and sides of the rear periphery 14 bounding the wall opening 16 may be defined by respective rear edges of a top panel 12 that may be orthogonal to the wall opening. Further, it is to be understood that the right side panel 58 may be connected to a right end portion of the top panel 12 and may be perpendicular thereto. Even further, the left side panel 56 may be connected to a left end portion of the top panel 21 and may be perpendicular thereto.

Continuing in reference to FIG. 5, the housing 10 may also include plural tape elements 34. It is to be understood that the tape elements 34 may be arranged at each corner of the rear periphery 14. In other embodiments, the tape elements 34 may be placed on tabs of the housing 10 that may extend away from the edges of a panel on the housing 10. However, it is to be understood that the tape elements 34 may be placed on any other appropriate portion or surface of the housing 10 such that the tape elements 34 may be engaged with a wall on which a pre-existing toilet paper roller is mounted. Thus, the housing 10 may remain static relative to a pre-existing toilet paper roller, such as the toilet paper roller 18 described herein.

While the particular TOILET PAPER DISPENSER FOR COVERING WALL-MOUNTED PRE-EXISTING TOILET PAPER ROLLER AND AUTOMATING HANDS-FREE TOILET PAPER EXTRACTION THEREFROM is herein shown and described in detail, it is to be understood that the subject matter which is encompassed by the present invention is limited only by the claims.

What is claimed is:

1. A toilet paper dispenser for covering a wall-mounted pre-existing toilet paper roller and automating hands-free toilet paper extraction therefrom, comprising as an end product:

a hollow housing defining a rear periphery defining a wall opening configured for accepting the wall-mounted pre-existing toilet paper roller therethrough, the wall opening not being closable or coverable by structure on the housing;

a pair of operating rollers rotatably mounted in the housing and closely spaced from each other parallel to each other to closely receive toilet paper from the wall-mounted pre-existing toilet paper roller therebetween;

a motor in the housing and coupled to the operating rollers to rotate at least one of the rollers;

a presence sensor on the housing;

a processor on the housing receiving signals from the presence sensor and responsive to a signal indicating presence of a hand, energizing the motor to turn the operating rollers;

the housing further defining a front periphery defining a front opening for access to the wall-mounted pre-existing toilet paper roller, the front opening being selectively covered by a movable panel of the housing, the housing further defining a bottom opening through which toilet paper is dispensed from the housing.

2. The dispenser of claim 1, comprising four tape elements arranged on the rear periphery, one at each corner thereof.

3. The dispenser of claim 1, wherein the operating rollers have tacky surfaces.

4. The dispenser of claim 3, wherein the operating rollers have soft plastic or rubber surfaces.

5. The dispenser of claim 1, wherein the motor is coupled to only a first one of the operating rollers, a second one of the operating rollers not being coupled to the motor.

6. The dispenser of claim 1, wherein the motor is coupled to both operating rollers.

7. The dispenser of claim 1, wherein the housing is parallelepiped-shaped and made of plastic.

8. The dispenser of claim 1, wherein a top and sides of the rear periphery bounding the wall opening are defined by respective rear edges of a flat top panel that is orthogonal to the wall opening, a flat right panel connected to a right end portion of the top panel and perpendicular thereto, and a flat left panel connected to a left end portion of the top panel and perpendicular thereto.

9. The dispenser of claim 8, wherein the bottom opening is defined by a slot in a bottom panel connecting bottom end portions of the left and right side panels.

10. A method, comprising:

disposing a housing over a wall-mounted pre-existing toilet paper roller without removing the wall-mounted pre-existing toilet paper roller from a wall on which it is mounted;

engaging paper from the wall-mounted pre-existing toilet paper roller with at least one operating roller in the housing; and responsive to detection of presence of a hand near the housing, automatically rotating the operating roller to translationally move paper through an opening in the housing such that the paper can be grasped by a person and torn from a roll of paper for use.

11. The method of claim 10, wherein four tape elements are arranged on rear portions of the housing, one at each corner thereof, so that the housing disposed over the wall-mounted pre-existing toilet paper roller remains static relative to the toilet paper roller when the tape elements are engaged with the wall.

12. The method of claim 10 wherein the at least one operating roller has a tacky surface.

13. The method of claim 10, wherein the at least one operating roller has soft plastic or rubber surface.

14. The method of claim 10, wherein the operating roller is a first operating roller and the method further comprises engaging paper from the wall-mounted pre-existing toilet paper roller between the first operating roller and a second operating roller in the housing.

15. The method of claim 10, further comprising providing a motor coupled to the at least one operating roller to automatically rotate the at least one operating roller to translationally move paper through the opening in the housing.

16. The method of claim 15, wherein the motor is coupled to two operating rollers.

17. The method of claim 10, wherein the opening is defined by a slot in a bottom portion of the housing.

* * * * *